US007818946B2

(12) United States Patent
Luechinger

(10) Patent No.: US 7,818,946 B2
(45) Date of Patent: Oct. 26, 2010

(54) TRANSFER DEVICE FOR LABORATORY CONTAINERS

(75) Inventor: Paul Luechinger, Uster (CH)

(73) Assignee: Mettler-Toledo AG, Greifensee (CH)

( * ) Notice: Subject to any disclaimer, the term of this patent is extended or adjusted under 35 U.S.C. 154(b) by 38 days.

(21) Appl. No.: 12/260,297

(22) Filed: Oct. 29, 2008

(65) Prior Publication Data

US 2009/0145510 A1 Jun. 11, 2009

(30) Foreign Application Priority Data

Dec. 6, 2007 (EP) ..... 07122531

(51) Int. Cl.
*B65B 31/00* (2006.01)

(52) U.S. Cl. ..... 53/90; 53/467; 53/79; 53/89; 222/153.04

(58) Field of Classification Search ..... 53/467, 53/471, 79, 89–90, 133.1, 128.1; 604/406–407; 222/71, 153.01, 153.04, 153.13
See application file for complete search history.

(56) References Cited

U.S. PATENT DOCUMENTS 1,827,286 A 10/1931 Glynn
2,968,423 A * 1/1961 Mahler et al. ..... 222/49
4,875,324 A * 10/1989 Cohrs ..... 53/88
5,484,070 A 1/1996 Graham
5,620,434 A * 4/1997 Brony ..... 604/406
6,330,960 B1 * 12/2001 Faughey et al. ..... 222/205
7,047,709 B2 * 5/2006 Hamilton ..... 53/469
7,621,715 B2 * 11/2009 Borderi et al. ..... 414/810

FOREIGN PATENT DOCUMENTS

EP 0614828 A1 9/1994
EP 1912073 A1 4/2008

* cited by examiner

*Primary Examiner*—Christopher Harmon
(74) *Attorney, Agent, or Firm*—Standley Law Group LLP

(57) ABSTRACT

A device connects a storage container to a working reservoir for transferring a substance from the storage container to the working reservoir. The device includes a housing which is joined to the storage container with either a fixed connection or a coupling means. A passage opening is formed on the housing, and a shutter that is movably connected to the housing serves to close the passage opening. The shutter has a connector port for each working reservoir. The shutter moves in a rotary or sliding manner relative to the housing between an open position and a closed position. In the closed position, the passage opening is closed off by the shutter, and in the open position the interior space of the storage container is connected through the passage opening to the interior space of the working reservoir which is seated in the at least one connector port.

12 Claims, 7 Drawing Sheets

TRANSFER DEVICE FOR LABORATORY CONTAINERS

CROSS-REFERENCE TO RELATED APPLICATIONS

This application claims a right of priority under 35 USC §119 from European patent application 07 12 2531.2, filed 6 Dec. 2007, the content of which is incorporated by reference as if fully recited herein.

TECHNICAL FIELD

The invention relates to a transfer device for laboratory containers which makes it possible to transfer a substance in powder form quickly, safely, and without spilling the substance, from a first container into a second container. Applications envisioned for the device are primarily in connection with dosage-dispensing devices for powders which have a dispensing head that is fed by a working reservoir. The working reservoir can be configured as a container which can be coupled to the dispensing head or has a fixed connection to the dispensing head, or also as a hollow space inside the dispensing head itself.

When the supply of substance in the working reservoir has been used up, the latter will have to be refilled, an operation where substance is transferred from a storage container into the working reservoir. In many laboratories, this transferring of substance from a first into a second container is a process that occurs with relative frequency and can be performed by simple pouring, if the container to be filled has a large enough opening and/or an accidental spillage of substance can be tolerated.

If on the other hand the container to be filed has only a small opening, if the substance to be transferred is toxic. or if for other reasons any spillage of even the smallest quantities must be avoided, the manual pouring or also the transferring by means of conventional utensils such as funnels or spatulas gets to be a relatively time-consuming and possibly critical or dangerous operation.

A further difficulty occurs also in the transferring of substances which react with the ambient atmosphere or have a strong tendency to absorb moisture. This problem could be solved by transferring the substance inside a so-called glove box under a protective gas atmosphere, but this is complicated and time-consuming.

BACKGROUND OF THE ART

Coupler devices with closure valves have long been known in the prior art. They are used particularly in situations where it needs to be prevented after a transfer that the transferred fluid spills out of the separated coupler parts.

A coupler device with closure valves is disclosed in U.S. Pat. No. 1,827,286 A. The subject is in this case a coupler unit for railroad cars and locomotives. Each of the coupler halves has a ball valve which can be individually actuated and which can be closed before separating the coupler halves, if necessary, so that after separating the coupler device, the gas pressure in the conduits can be maintained and the brakes will not be engaged.

The know state of the art further includes many bottle closures with a fold-down closure cap. A bottle closure of this type is disclosed for example in U.S. Pat. No. 5,484,070, which in addition includes a child safety device.

The bottle closures of the known state of the art are entirely unsuitable for a safe transfer of the aforementioned toxic substances, since no seal-tight connection can be achieved between the mouth of the closure and the working reservoir without first folding back the closure cap and exposing the opening of the bottle.

Couplers with closure cap and exposing the opening of the bottle.

Couplers with closure valves in both coupler parts are likewise not suited for the purpose, as there is a dead volume between the two valve where residues of the transferred substance remain caught and can get into the environment as soon as the coupler parts are separated.

It is therefore the object of the present invention to provide a transfer device for laboratory containers which allows in particular a substance in powder form to be transferred quickly and safely from a first container into a second container, wherein the transfer of the substance from the first into the second container occurs in essence under a tight seal, so that no substance particles can escape to the outside during and after the transfer operation, or that the gaseous medium in the container is prevented as much as possible from mixing with the ambient air.

SUMMARY

This objective is met by a transfer device according to the accompanying claims, as well as by a transfer method for substance in powder form according to claim 12. Details and further developed embodiments of the invention are defined in the further, subordinate claims.

A transfer device according to the present invention includes a housing which is attached to a storage container either with a fixed connection or with coupling means. The coupling means can for example be a screw-threaded connection, a snap connection, or even a simple plug-in connection. The housing of the transfer device has a passage opening as well as a shutter which serves to close the passage opening and is movably connected to the housing. The shutter has at least one connector port for at least on working reservoir and is rotatable or slidable relative to the housing between at least one open position and at least one closed position. In the closed position, the passage opening is closed off by the shutter, and in the open position the interior space of the storage container is connected by way of the passage opening to the interior space of the working reservoir which is set into the at least one connector port.

The transfer device according to the invention is suitable for connecting containers with each other, in particular for the purpose of transferring a powdery substance from a first container, hereinafter referred to as storage container, into a second container, hereinafter referred to as working reservoir. Since the working reservoir is designed for direct connection to the shutter, the opening of the working reservoir can be slid directly over the passage opening. Consequently, no separable connector ducts are required which would entail the risk that the substance could escape into the environment as soon as the ducts are separated from each other.

The transfer device according to the invention makes it possible that the opening of a storage container that was in the closed state before the substance transfer can be opened and also closed again while the container opening remain coupled together. With this arrangement, the transfer operation is carried out for example in such a way that the working reservoir that is to be filled is coupled to a storage container which is closed up by means of the transfer device and is arranged in a holder with its orifice pointing downward. By sliding or swiveling the shutter, the passage opening is opened up, allowing substance to flow from the storage container into the working reservoir that is to be filled. With this arrangement, the substance can pass from the storage container into the working reservoir. At the same time, the gas in the working reservoir is displaced by the incoming substance and streams into the storage container, helped by the pressure deficit which is caused in the storage container by the outflow of substance. This prevents any dust from escaping to the outside of the transfer device according to the invention. Following the transfer, the shutter is shut again, and the working reservoir is released from the connector port and closed up.

The ability created by the invention to keep a storage container closed up as long as the container openings are not coupled together has the further advantage that the contents of a storage container that is closed up in this manner are barred from any contact, even if only momentary, with the ambient atmosphere, whereby for example an absorption of moisture or an Oxidation of the substance inside the container can be prevented.

The transfer device according to the invention can be configured in such a way that the shutter is opened and closed through a manipulation from the outside, for example by a human operator. In an advantageous embodiment, at least the working reservoir to be filled consists of a transparent material, allowing the operator to observe the transfer of material and to control it by adjusting the shutter.

Provided that the play between the shutter and the housing is narrower than the smallest particle size, no substance can escape through this gap into the environment.

However, as a practical matter, as least one seal ring is arranged at the mouth of the passage opening, coaxial to the latter, which is in constant contact with the shutter. When sliding or swiveling the shutter, substance residues are wiped off the mouth of the working reservoir by means of this seal ring and held back in the passage opening and/or sent to the working reservoir. The shape of the seal ring and its cross-section can be arbitrarily chosen and does not necessarily have to be circular-shaped.

For a higher degree of safety, further seal elements can be arranged between the shutter and the housing, for example a bellows.

The invention provides for possibilities of a positive interlock to secure the connection of the transfer device with the storage container and the working reservoir. For example, the connection of the working reservoir set into the at least one connector port can be inseparably secured by means of a connector port lock when the shutter is in the open position. The shutter can furthermore be locked into the closed position by means of the connector port lock, if there is no working reservoir connected to the at least one connector port.

The reciprocal interlocking function between the presence of a working reservoir in the connector port and the release of the shutter can be achieved in a particularly advantageous way through the concept that when a working reservoir is set into the connector port the lock of the shutter is being actuated and the shutter is unlocked, and that by taking the working reservoir out of the connector port, the shutter is automatically locked again.

An embodiment of the transfer device with a plurality of connector ports formed on the shutter is particularly well suited for applications where several working reservoirs are to be filled with the same substance from a storage container. Concerning the possibility that not all of the existing connector ports are occupied with working reservoirs to be filled, it is envisioned that the swivel angle or the sliding path of the shutter is unlocked only as far as there are connector ports occupied in an uninterrupted sequence by working reservoirs, so as to prevent that substance can flow out through unoccupied connector ports.

In the case where the housing of the transfer device is not inseparably connected to the storage container but is coupled to the latter through a coupling means, a locking device can be provided for the coupling means for prevent the storage container from being opened unintentionally.

The coupling means for connecting the transfer device to a storage container and also the connector port for the connection to a working reservoir can be designed for example as a screw connection, a bayonet coupling, a snap engagement device or a plug-in-device. Preferably the coupling means and the connector port are unmistakably distinguished from each other, so that the coupling means can only be connected to a storage container and the connector port can only be connected to a working reservoir.

It is further advantageous if the transfer device and the storage containers and working reservoirs that are to be connected to it are standardized in such a way that storage containers can be connected directly to the coupling means and working reservoirs can be connected directly to the connector port. Suitable adapters can be created for storage containers and working reservoirs which do not conform to this connector standard. Further, in order to avoid dead volumes as described above, these adapters preferably remain on the containers rather than on the transfer device. Different containers are thereby provided with a standardized interface, through which they can also be connected in a simple manner to an instrument with the same standardized interface, for example a dosage-dispensing device.

The housing of the transfer device can also be designed to include a refillable chamber for a desiccant or a connector socket for an exchangeable desiccant cartridge, wherein the desiccant communicates with the atmosphere in the interior space of the storage container and absorbs moisture that may be present in the substance in the storage container.

There can further be at least one connector port for gas arranged on the housing of the transfer device, through which for example a protective gas can be brought in. If there is a gaseous medium contained in the storage container or in the working reservoir, it can be replenished through the connector port. This can have a variety of advantages. By introducing a suitable gas, it is possible for example to change the flow properties of the substance or even to influence the ability of the substance to enter into reactions. Of course, it is also possible to arrange several gas connector ports which are connected to individual area of the transfer device of the present description and/or to the storage container and/or to the working reservoir.

After it has been filled, the working reservoir can be closed manually for example with a lid belongs to the reservoir container. However, it could also be envisioned that a closure seal device and/or a closure device is arranged on the housing of the transfer device, which servers to put a lid, a stopper and/or a sealing sticker on the fill opening of the working reservoir at the time when the latter is being separated from the connector port after it has been filled.

To ensure the tightest possible connection between the storage container and the working reservoir during the transfer operation, the at least one connector port can include a spring element by means of which a working reservoir that has been set into the connector part can be held under tension against the housing.

A method for transferring a substance from a storage container into a working reservoir, which are connected to each other by the transfer device according to the invention, includes in essence the following steps:

a storage container is connected to the coupling means of a transfer device. This entails for example unscrewing a screw cap of the storage container and replacing it with the transfer device, with the shutter being in the closed state;

at least one working reservoir is connected to the shutter by the way of at least one connector port;

prior to opening the passage opening, the working reservoir is connected to a desiccant chamber, if applicable, by sliding or swiveling the shutter;

by way of a connector port for protective gas, if applicable, the gaseous medium which may be present in the storage container and/or in the working reservoir is replaced by an inert protective gas;

the passage opening is opened by sliding or swiveling the shutter, and the containers connected to the transfer device are brought into a transfer position, so that the substance will flow under its own gravity from the storage container into the working reservoir;

after the working reservoir has been filled, the shutter is closed again; and the working reservoir is sealed by means of a closure seal device and/or the working reservoir is released from the connector port.

BRIEF DESCRIPTION OF THE DRAWINGS

The transfer device according to the invention is explained hereinafter in more detail through examples and with references to drawings, wherein.

DETAILED DESCRIPTION

Figure 1:
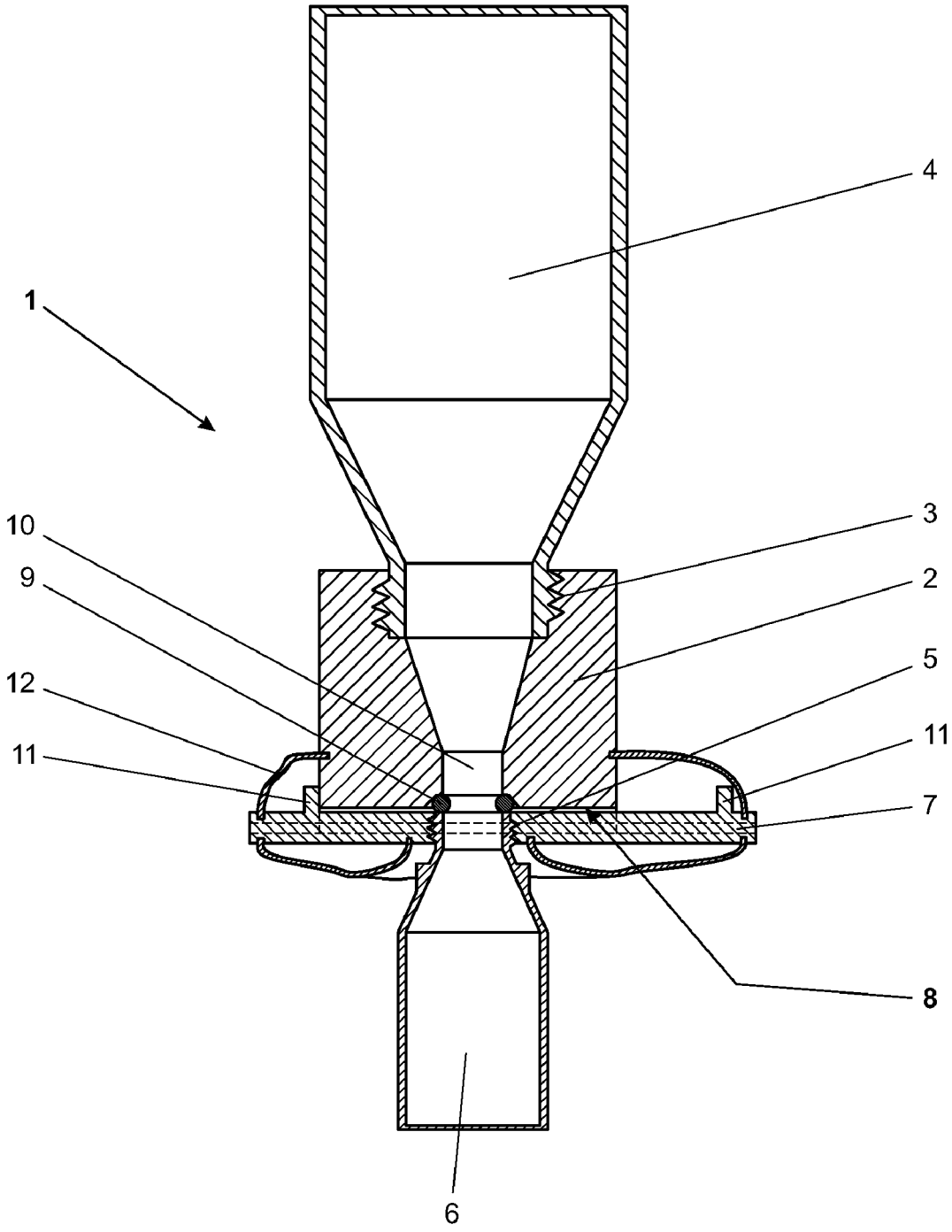
FIG. 1 shows a cross-sectional, schematic illustration of a transfer device in frontal view, with a screw-threaded connection as the coupling means to the storage container and a further screw-threaded connection for the connector port to a working reservoir, as well as a linear slid shutter in the open position.

In a sectional drawing with the view directed from the front, FIG. 1 schematically illustrates a transfer device 1 with a housing 2, which has a first screw-threaded connection as the coupling means 3 to a storage container 4. The shutter 7 is configured as a linear slide shutter and is guided in the housing 2 in a guide track 8 that is open at both ends, wherein the mobility of the shutter is limited in both directions by end stops 11. A second screw-threaded connection is formed in the shutter 7 as connector port 5 to a working reservoir 6. As shown in the drawing, in one end position of the shutter 7, the connector port 5 lines up with a passage opening 10 that is formed in the housing 2, so that the interior space of the storage container 4 is connected to the interior space of the working reservoir 6 by an open path through the passage opening 10 and a substance in powder-form or a granulate can flow under its own gravity from the storage container 4 into the working reservoir 6.

In the other end position of the shutter 7, the connector port 5 and with it the mouth of the working reservoir 6 is offset from the passage opening 10, so that the passage opening 10 is closed off by the shutter 7. The configuration of the shutter 7 as a manually movable slide shutter is particularly advantageous in connection with a working reservoir 6 that is made of a transparent material, as the progress in the filling of the working reservoir 6 can be observed and the material flow can be controlled and stopped by moving the shutter 7. To prevent that substance particles could escape into the environment, the transfer device 1 has two sealing systems. The first sealing system is a seal ring 9 of annular shape, coaxial with the passage opening 10. This seal ring 9 seals on the one hand the gap (for better visibility shown with exaggerated width in the drawing) between the housing 2 and the shutter 7. On the other hand, in the process of closing the shutter, the end surface of the mouth of the working reservoir 6 is wiped clean of substance particles sticking to it. and the particles are held back in the passage opening 10. For this design to function in a satisfactory manner, the end surface of the mouth of the working reservoir 6 should be approximately in flush alignment with the upper edge of the shutter 7. Of course,, the seal ring 9 or a ring-shaped sealing lip performing the same function could also be arranged at the mouth of the working reservoir 6. The second sealing system is a flexible bellows 12 which is arranged between the housing 2 and the shutter 7 and which prevents an uncontrolled escape of substance particles into the environment. Both sealing systems further prevent an exchange of gaseous medium between the ambient atmosphere and the substance-containing internal spaces.

Figure 2:
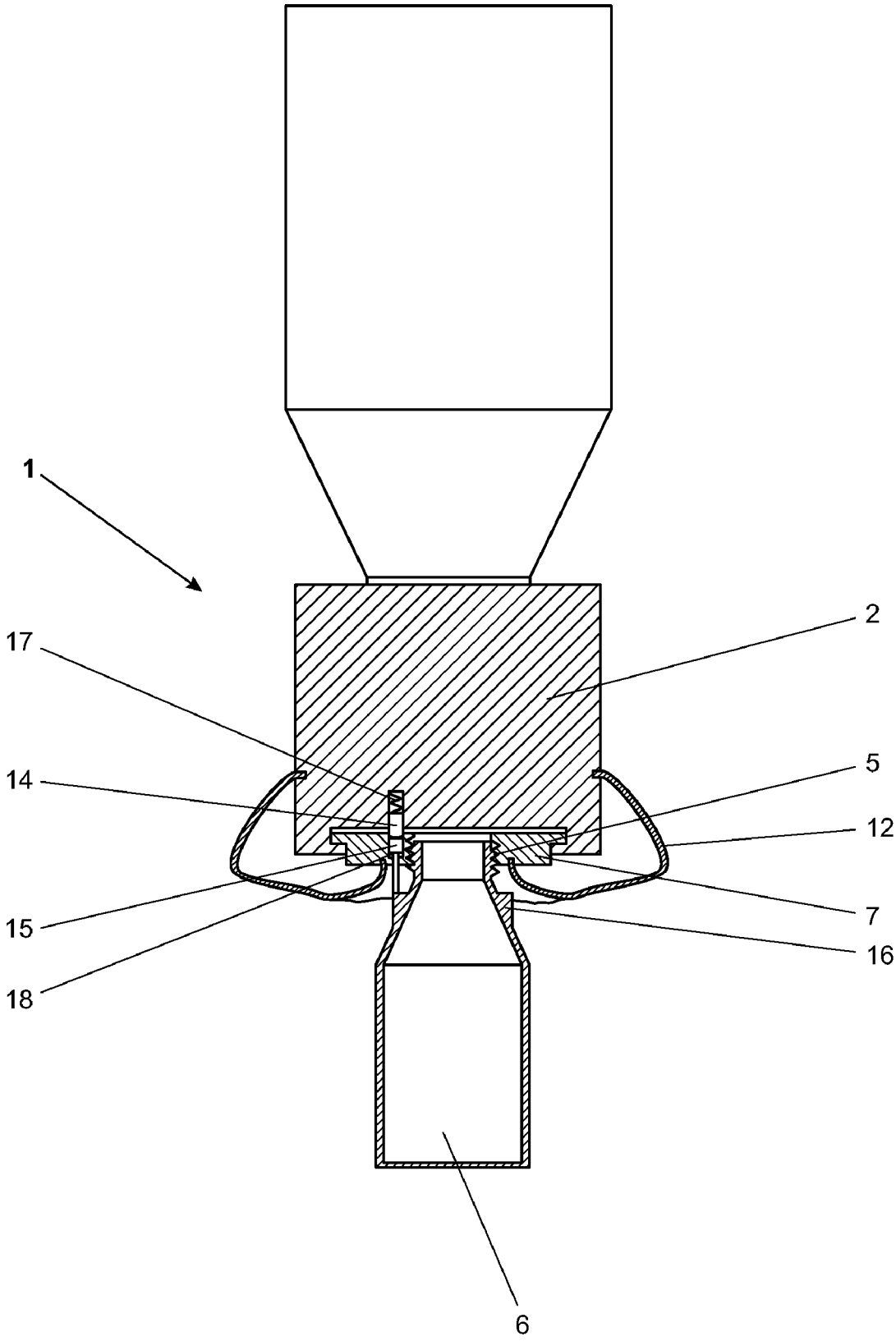
FIG. 2 shows the transfer device of FIG. 1 again in a cross-sectional illustration but, in contrast to FIG. 1, in a side view and in the closed position.

FIG. 2 shows the transfer device 1 of FIG. 1 again in a cross-sectional illustration but, in contrast to FIG. 1, in a side view and in the closed position. Clearly visible are the longitudinal guide track which guides the shutter 7 in the housing 2 and the bellows 12 which encloses the shutter 7.

FIG. 2 further illustrates an embodiment of a locking device for the connector port. A locking bold 14 which is movably constrained in the housing 2 reaches in its closed state into a hold 18 in the shutter 7. To always ensure a secure engagement of the locking bolt 14, the latter in biased in the direction towards the shutter 7 by means of a spring 17 which is seated against the housing 2. The hold 18 further holds a plunger 15 with linear mobility. As soon as a working reservoir 6 is screwed into the connector port 5, a collar 16 which is formed on the working reservoir 6 pushes against the plunger 15, moving the latter along its central lengthwise axis and thereby pushing the locking bolt 14 out of the hole 18 against the biasing force of the spring 17. As soon as the locking bolt 14 has been pushed completely out of the hole 18, the shutter 7 can be moved relative to the housing 2.

Figure 3A:
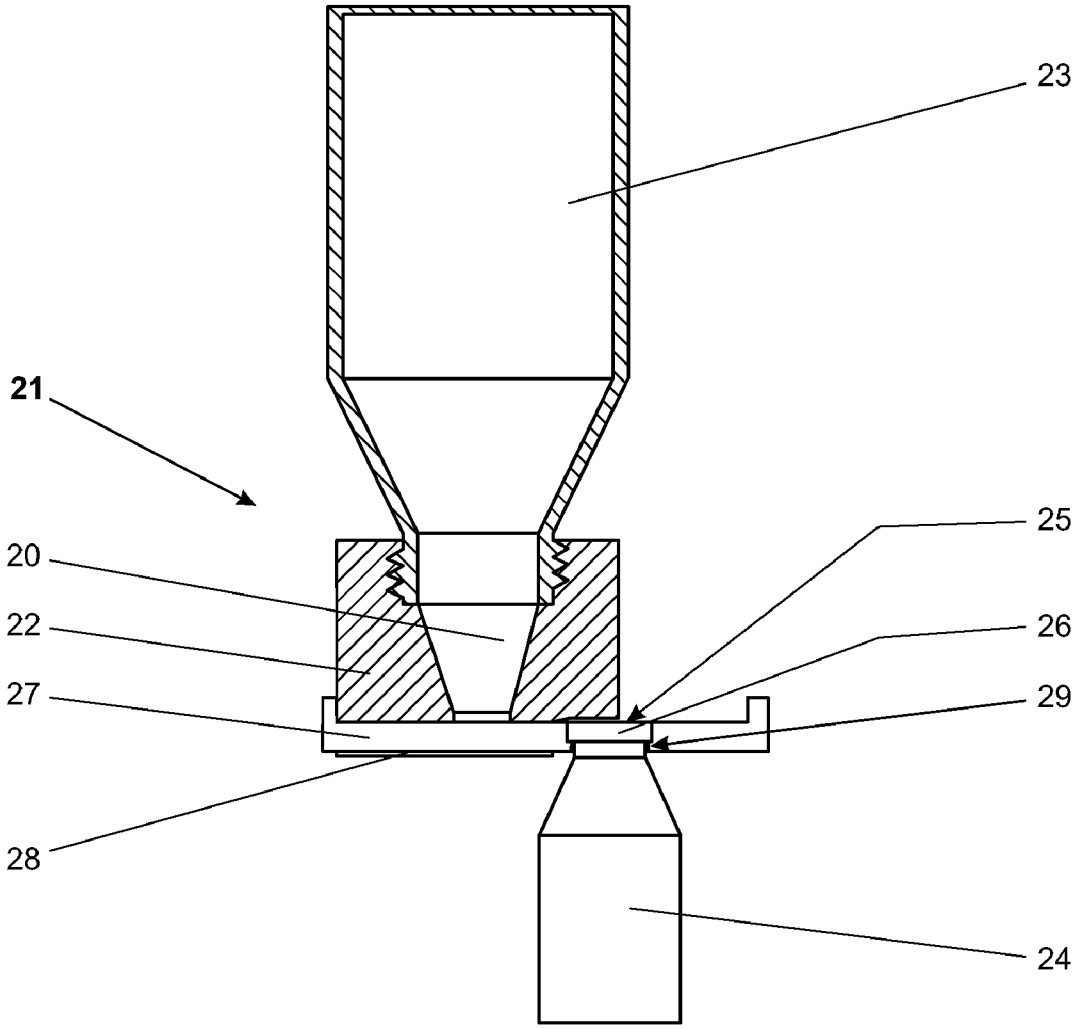
FIG. 3A shows as an example a cross-sectional drawing of a transfer device in frontal view, with a screw-threaded connection as a coupling means to the storage container, with a connector port to which a working reservoir can be connected by insertion from the side, and with a linear slide shutter.
Figure 3B:
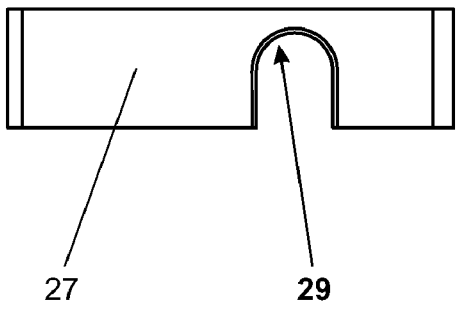
FIG. 3B shows the linear slide shutter with the U-shaped connector port.

The transfer device 21 in FIG. 3A has a housing 22 which is connected to a storage container 23. A shutter 27 with a connector port 29 is constrained with linear mobility in a guide tract 28 of the housing 22. For better clarity, the shutter 27 is shown in FIG. 3B in plan view. As is evident from FIG. 3B, the connector port 29 is of a U-shaped configuration.

As shown in FIG. 3A, the passage opening 20 traversing the housing 22 is closed off by the shutter 27 when there is no working reservoir seated in the connector port 29. The flange 26 formed at the mouth 25 of the working reservoir 24 is set from the side into the connector port 29, and the working reservoir 24 together with the shutter 27 is slid along the housing 22 until the mouth 25 lines up with the passage opening 20. In this position, the guide track 28 not only embraces the lengthwise edges of the shutter 27 but also holds the mouth 25 captive and prevents the flange 26 from slipping out of the side of the connector port 29. In other words, the working reservoir 24 is locked into the connector port 29 when the shutter 27 is in its open position. In order to release the connection to the working reservoir, the shutter 27 is returned to the closed position, and only at this point can the working reservoir 24 be removed again from the connector port 29.

Figure 4:
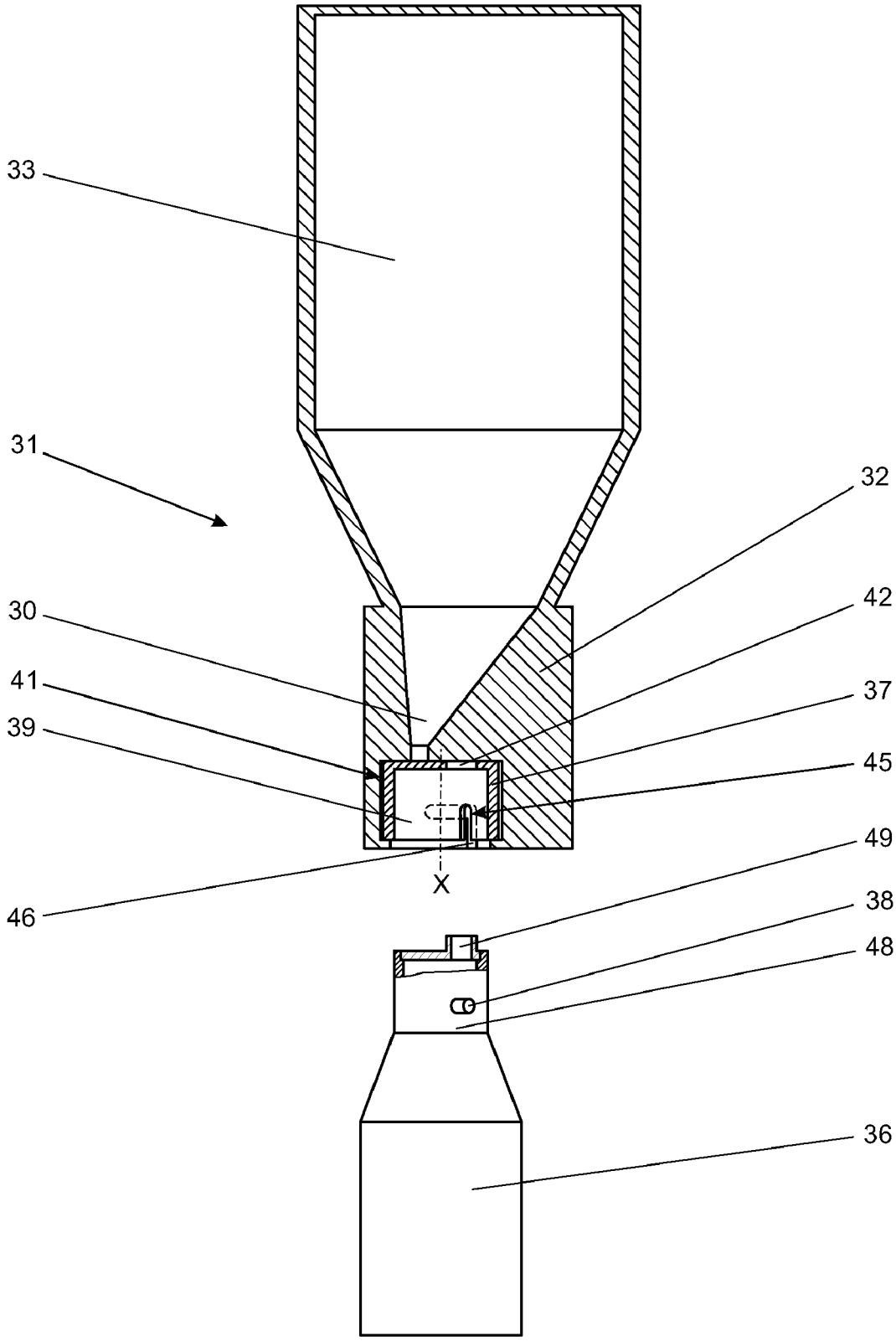
FIG. 4 shows an example of a transfer device with a connector port for a working reservoir configured in the manner of a bayonet coupling, and with a swivel shutter.

In transfer device of FIG. 4, the foregoing concept of locking the working reservoir to the connector port is realized analogously with a swivel shutter instead of a slide shutter. The transfer device 31 has a housing 32 which is connected to a storage container 33. The working reservoir 36 has a cylindrical neck 48 with at least one protruding pin 38. The housing 32 has a cylindrical bore 41 in which a shutter 37 has a cylinder-shaped recess which forms the connector port 39 and whose internal diameter essentially equals the diameter of the cylindrical neck 48. The bottom of the recess of the shutter 37 has a passage window 42 which is off-centered from the rotary axis X and in the open position gives free access to a passage opening 30 that is formed in the housing 32.

The connector port 39 for the working reservoir 36 is configured as a bayonet coupling which cooperates with the rotary shutter 37 in a mutually interlocked way, so that the passage opening 30 in housing 32 is closed when no working reservoir 36 is seated in the connector port. This interlocking function is achieved by means of at least one shutter slot 45 formed in the shutter 37 and by means of at least one L-shaped guide track 46 formed in the housing 32. In order to set a working reservoir 36 into the connector port 39, the pin 38 needs to be able to enter simultaneously into the shutter slot 45 and the guide track 46. As the pin 38 is constrained in the L-shaped guide track 46, the working reservoir 36 cannot be pulled out of the connector port 39 during the transfer process as long as the passage opening 30 is not closed up.

To prevent that substance could stick to the side walls of the passage window 42 a working reservoir adapter 49 is arranged at the mouth of the working reservoir 36. When the working reservoir 36 is seated in the shutter 37, the collar of the adapter 49 fits into the passage window 42, so that only the working reservoir adapter 49, but not the passage window 42, comes into contact with the substance. After the working reservoir 36 has been filled, the collar can be sealed tight for example with a protective cap. Possibly, the working reservoir adapter 49 could also be removed and replaced by a stopper plug.

The shutter 37 can be prevented from turning on its own by friction contact with the housing 32, or the shutter 37 can be biased by a torque spring (not shown) into the closed position, where the passage window 42 is offset by 180° against the passage opening 30.

Thus, by completely inserting the neck 48 into the connector port 39 and then turning it by 180°, the neck 48 is on the one hand secured in the connector port 39, more specifically in the housing 32, and on the other hand the shutter 37 is simultaneously turned into the open position, so that the path from the storage container 33 into the working reservoir 36 through the passage opening 30 and the passage window 42 is set free and the substance can flow under its own gravity from the storage container 33 into the working reservoir 36. After the working reservoir 36 is full, it is uncoupled again from the connector port 39 by turning and pulling, while the shutter 37 is taken along by the rotation and thus closes the passage 30 again.

Figure 5:
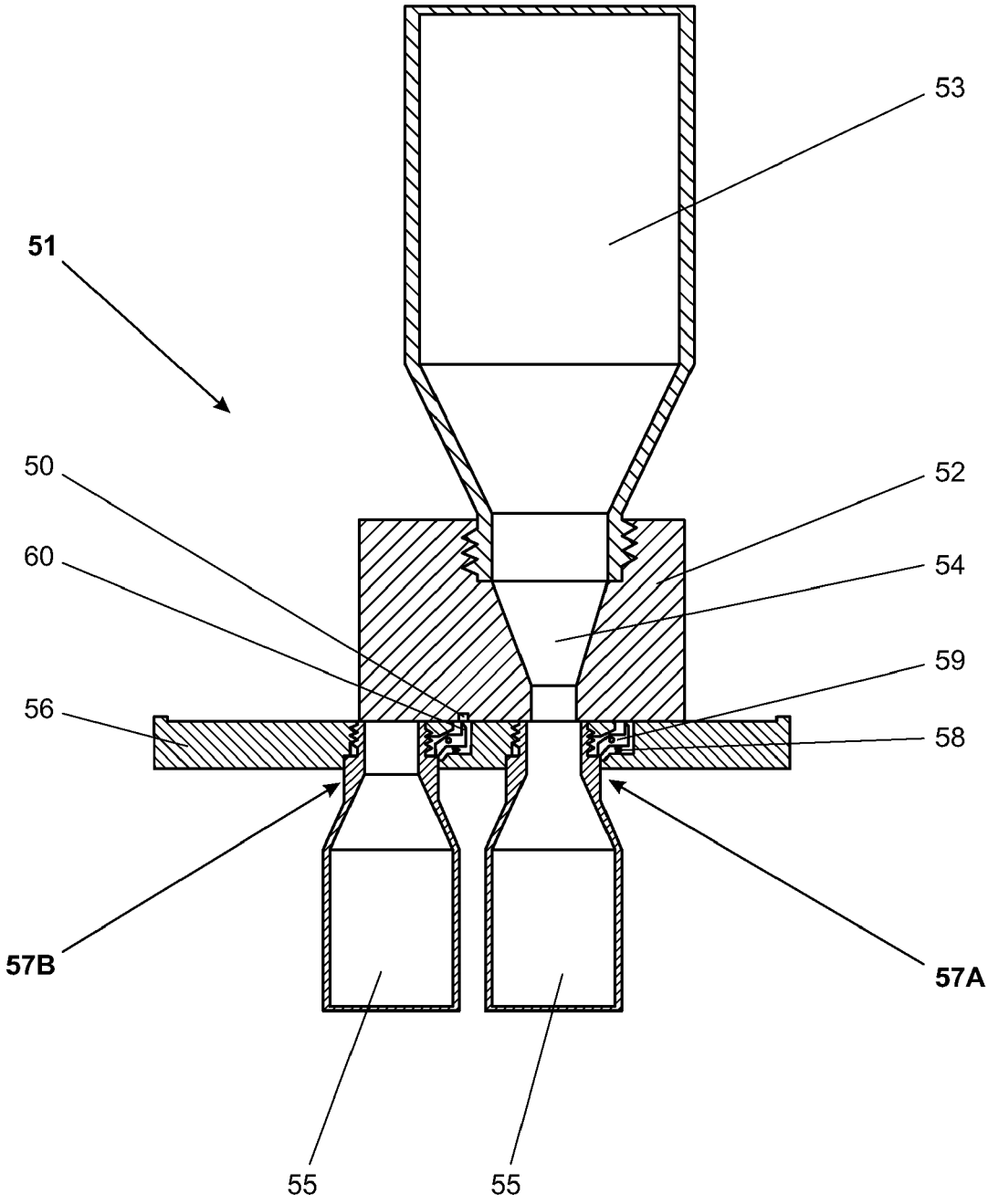
FIG. 5 shows an example of a transfer device with connector ports for two working reservoirs.

A transfer device according to the invention can also be equipped with more than one connector port for working reservoirs. FIG. 5 schematically illustrates a transfer device 51 with a housing 52 which is connected to a storage container 53. A passage opening 54 is arranged in the housing 52. The shutter 56 has two connector ports 57A, 57B for two working reservoirs 55. This arrangement allows a plurality of working reservoirs 55 to be filled serially. To prevent the shutter 56 of the transfer device 51 from being inadvertently moved to the open position when no working reservoir 55 is seated in one of the connector ports 57A, 57B, each of the connector ports 57A, 57B has a locking device. The essential parts of the latter are a rotatably pivoted locking segment 59 and a spring 58. With a locking detent 60 engaging a recess 50 that is formed on the housing, the locking segment 59 next inline to the passage opening 54 is secured in the locked position by the biasing force of a spring 58. When a working reservoir 55 is screwed into the connector port 57A, 57B, the locking segment 59 is tilted and the detent 60 is retracted from the recess 50.

Of course, possible embodiments also include transfer devices that allow several working reservoirs to be filled in parallel. However, to accomplish this, there have to be an equal number of passage openings in the housing as there are working reservoirs to be filled in parallel with each other.

Figure 6:
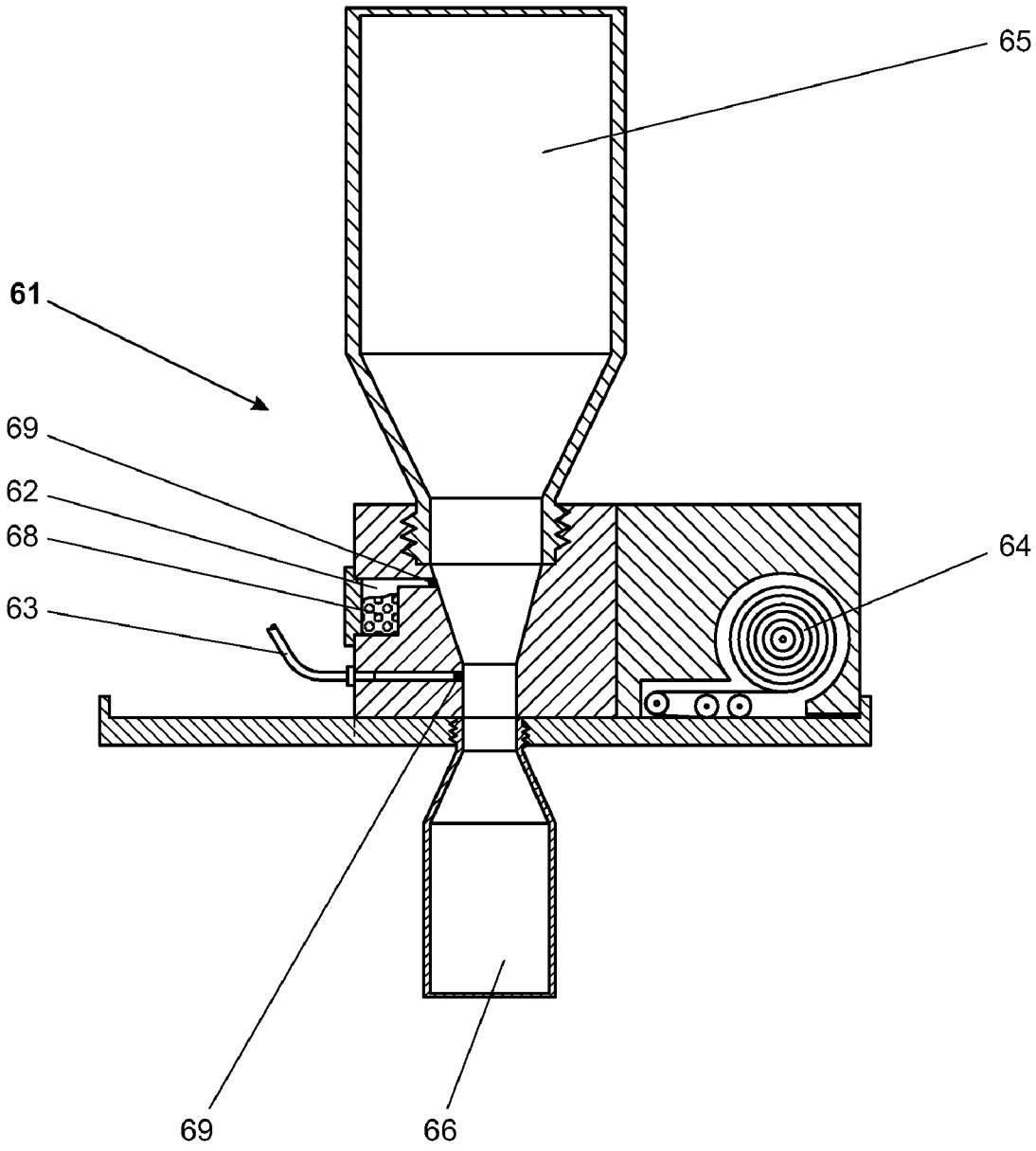
FIG. 6 shows an example of a transfer device with a chamber for a desiccant, a gas connector port, and a closure seal device.

As illustrated in FIG. 6, a transfer device 61 according to the invention can in addition be equipped with a chamber 62 for a desiccant and/or with a gas connector port 63 and/or with a closure sealing device 64, represented symbolically by a label sticker roll. The closable chamber 62 serves to receive a desiccant 68, for example if the transfer device 61 is connected to a storage container 65 with a hygroscopic substance. The gas connector port 63 allows for example a connected working reservoir 66 to be supplied with gas before or while being filled with substance, so that the substance cannot absorb moisture during the filling process and before the working reservoir 66 is closed up. The gas connector port 63 and the chamber 62 are protected by a gas-permeable membrane 69, so keep substance from entering. The closure seal device 64 is connected directly to the transfer device 61 and configured in such a way that after the filling process the working reservoir 66 is moved on immediately to the closure seal device 64, where the mouth of the container can be closed in the conventional manner with a lid or a sticker.

Figure 7:
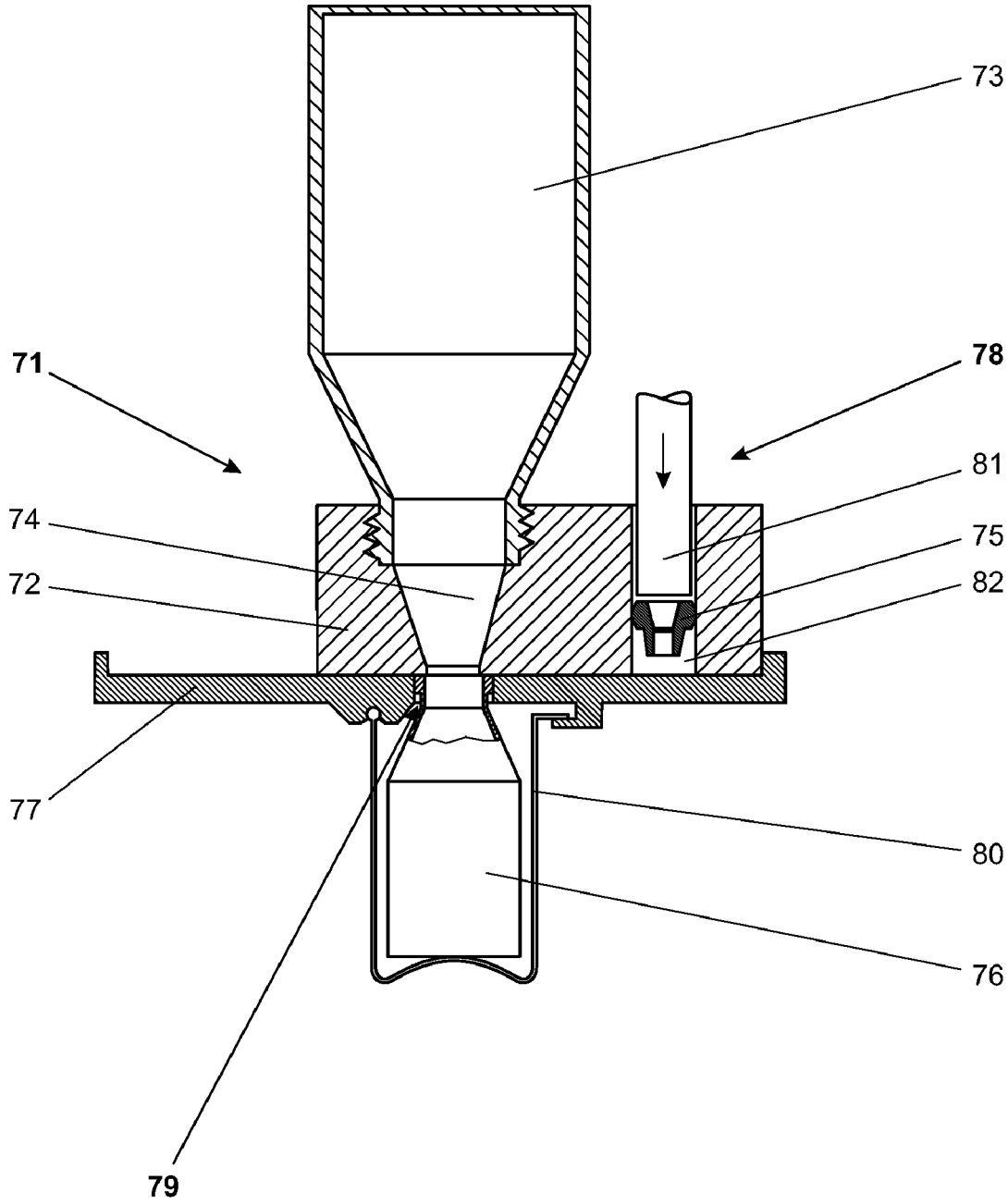
FIG. 7 show an example of a transfer device with a connector port equipped with a spring element, and with a closure device for stopper plugs.

FIG. 7 shows a transfer device 71 with a housing 72 which is connected to a storage container 73. A shutter 77 with a connector port 79 is constrained to slide along a linear guide track (not shown) of the housing 72. The connector port 79 is essentially a passage hole. To keep a working reservoir 76 reliably seated in the connector port 79, the shutter 77 has a spring element 80 in the form of a spring bracket, by means of which the fill opening of the working reservoir 76 can be pushed against the housing 72 and the working reservoir 76 can be clamped in place.

As shown in FIG. 7, this produces a gap-free contact between the housing 72 and the fill opening of the working reservoir 76. As soon as the fill opening lines up with the passage opening 74 in the housing 72, the substance transfer can take place. After the transfer process is completed, the shutter 77 can be slid along a straight path into the closing position, where the fill opening of the working reservoir 76 is brought into the operating area of a closure device 78 with stopper plugs 75. This closure device 78 consists essentially of a bore hole 82 in the housing 72, in which a piston 81 is loosely guided. As illustrated schematically, the stopper plug 75 is pushed by means of the piston 81 into the fill opening. Preferably, the stopper plug 75 is held in the bore hole 82 by a slight contact friction, so that the stopper plug 75 moves in the direction of the fill opening only when pushed by the piston 81 but will not, for example, fall into the fill opening under its own weight. As soon as the fill opening is closed with the stopper plug, the spring element 80 can be released, and the filled and closed working reservoir 76 can be removed from the connector port 79.

Although the invention has been presented through specific examples of embodiments, there are obviously numerous further variations that could be created from a knowledge of the present invention, for example by combining the features of the individual embodiments with each other and/or by exchanging individual functional units of the embodiments against each other. In particular, there are further embodiments conceivable in which the subject of the invention could be incorporated, for example if the transfer device in an automated version is used as a component of a larger system.

What is claimed is:

1. A device for transferring a substance from a storage container to a working reservoir, comprising:

a housing;

a fixed connection or a coupling means formed on the housing, through which the storage container is connected to the housing;

a passage opening formed on the housing, the passage opening communicated to an interior space of the connected storage container; and a shutter, comprising a connector port adapted for seating the working reservoir, the shutter rotating or sliding relative to the housing from an open position to a closed position, such that:

in the open position, the shutter aligns the interior space of the storage container to a mouth of the working reservoir that is seated in the connector port, through the passage opening; and in the closed position, the shutter offsets the mouth of the working reservoir from the passage opening.

2. The device of claim 1, further comprising:

a device for inseparably locking the connector port into a seated connection with the working reservoir, when the shutter is in the open position.

3. The device of claim 2, further comprising a device for locking the shutter that immobilizes the shutter in the closed position when no working reservoir is connected to the connector port.

4. The device of claim 3, wherein:

the shutter comprises at least two connector ports; and the shutter locking device limits rotation or sliding of the shutter only as far as there are connector ports that are occupied by working reservoirs following each other in an uninterrupted sequence.

5. The device of claim 1, wherein:

the coupling means is adapted to be non-releasably connected to the storage container; or the device further comprises a storage container lock which locks up the coupling means.

6. The device of claim 1, wherein:

the means for connecting the connector port to the working reservoir and the means for connecting the coupling means to the storage container are each selected from the group consisting of: a screw connection, a bayonet coupling connection, a snap engagement connection, and a plug-in connection.

7. The device of claim 1, wherein:

the connector port has a standardized fitting design and is adaptable with an adapter for connecting a working reservoir with a non-standard working reservoir thereto.

8. The device of claim 1, further comprising:

a chamber or a connector port for attaching a chamber, formed in the housing, the chamber being filled with a desiccant.

9. The device of claim 1, further comprising:

a gas connector port arranged in the housing.

10. The device of claim 1, further comprising:

a closure seal device for affixing a seal on a fill opening of the filled working reservoir; and/or a closure device for putting a stopper plug on a fill opening of the filled working reservoir.

11. The transfer device of claim 1, further comprising:

a spring element, co-acting with the connector port, to hold the working reservoir set into the connector port under tension against the housing.

12. The device of claim 1, further comprising a device for locking the shutter that immobilizes the shutter in the closed position when no working reservoir is connected to the connector port.

* * * * *

UNITED STATES PATENT AND TRADEMARK OFFICE

CERTIFICATE OF CORRECTION

PATENT NO. : 7,818,946 B2
APPLICATION NO. : 12/260297
DATED : October 26, 2010
INVENTOR(S) : Luechinger It is certified that error appears in the above-identified patent and that said Letters Patent is hereby corrected as shown below:

In column 1, line 35, please delete "toxic." and insert -- toxic, --.

In column 1, lines 5 and 6, please delete "Couplers with closure cap and exposing the opening of the bottle.".

In column 2, line 38, please delete "on" and insert -- one --.

In column 2, line 60, please delete "opening" and insert -- openings --.

In column 4, line 49, please delete "area" and insert -- areas --.

In column 4, line 53, please delete "lid belongs" and insert -- lid that belongs --.

In column 5, line 36, please delete "slid" and insert -- slide --.

In column 6, line 29, please delete "it." and insert -- it, --.

In column 6, line 51, please delete "latter in biased" and insert -- latter is biased --.

In column 7, line 24, after "shutter 37", please insert -- is seated with the freedom to swivel about a vertical rotary axis X. The shutter 37" --.

Signed and Sealed this

Fourteenth Day of December, 2010

David J. Kappos

David J. Kappos
*Director of the United States Patent and Trademark Office*